US008458910B2

(12) United States Patent
Haczek et al.

(10) Patent No.: US 8,458,910 B2
(45) **Date of Patent: *Jun. 11, 2013**

(54) HAIR REMOVING DEVICE

(75) Inventors: Werner Haczek, Idstein (DE); Bernhard Kraus, Braunfels (DE); Thorsten Piesker, Friedrichsdorf (DE); Markus Sabisch, Waldems (DE)

(73) Assignee: Braun GmbH, Kronberg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/356,877

(22) Filed: Jan. 24, 2012

(65) Prior Publication Data

US 2012/0137525 A1 Jun. 7, 2012

Related U.S. Application Data

(63) Continuation of application No. 12/066,455, filed as application No. PCT/EP2006/007993 on Aug. 12, 2006, now Pat. No. 8,127,453.

(30) Foreign Application Priority Data

Sep. 16, 2005 (DE) ..... 10 2005 044 175

(51) Int. Cl.
*B26B 19/02* (2006.01)

(52) U.S. Cl.
USPC ..... 30/43.92; 30/43.1; 30/527

(58) Field of Classification Search
USPC ..... 30/43.1, 43.91, 43.92, 527
See application file for complete search history.

(56) References Cited

U.S. PATENT DOCUMENTS

| | | | |
|---|---|---|---|
| 926,509 | A | 6/1909 | Rankin |
| 1,519,504 | A | 12/1924 | Edgardo |
| 2,186,091 | A | 1/1940 | Benner |
| 2,474,027 | A | 6/1949 | Berger |
| 3,279,056 | A | 10/1966 | Andis |
| 3,339,276 | A | 9/1967 | Tolmie et al. |
| 3,797,109 | A | 3/1974 | Yamada et al. |
| 4,505,036 | A | 3/1985 | Ochiai et al. |
| 4,688,329 | A | 8/1987 | Oord |
| 4,796,359 | A | 1/1989 | Oprach et al. |
| 5,233,746 | A | 8/1993 | Heintke |
| 5,234,441 | A | 8/1993 | Heintke et al. |

(Continued)

FOREIGN PATENT DOCUMENTS

| | | |
|---|---|---|
| AT | 327 735 | 2/1976 |
| DE | 36 10 736 | 10/1987 |

(Continued)

*Primary Examiner* — Hwei C Payer
(74) *Attorney, Agent, or Firm* — Jerry J. Yetter; Kelly L. McDow

(57) ABSTRACT

Described herein is a hair removal apparatus with a housing and an actuator head movable in the housing. The actuator head accommodates an actuator system that removes the hairs and is adapted to be driven by an electric drive mechanism arranged in the hair removal apparatus. The actuator system is movable into at least one active position for hair treatment. The actuator head is freely rotatable in the housing about an axis of rotation for adjustment of an active position. Using a single hair removal apparatus it is thus possible to employ various hair treatment systems such as long-hair cutters, short-hair cutters, or epilators, requiring only the actuator head to be turned about its bearing axis until the cutting unit provided for the respective hair treatment operation is turned into the actuator plane.

2 Claims, 6 Drawing Sheets

U.S. PATENT DOCUMENTS

| | | | | |
|---|---|---|---|---|
| 5,234,442 | A | 8/1993 | Schafer et al. | |
| 5,235,749 | A | 8/1993 | Hildebrand et al. | |
| 5,289,636 | A | 3/1994 | Eichhorn et al. | |
| 5,857,903 | A | 1/1999 | Ramspeck et al. | |
| 6,502,312 | B2 | 1/2003 | Beutel et al. | |
| 7,503,117 | B2 | 3/2009 | Wetzel et al. | |
| 7,503,118 | B2 | 3/2009 | Oh | |
| 7,707,725 | B2 | 5/2010 | Eichhorn et al. | |
| 7,832,104 | B2 | 11/2010 | Yamasaki et al. | |
| 8,112,892 | B2 * | 2/2012 | Haczek et al. | 30/50 |
| 8,127,453 | B2 * | 3/2012 | Haczek et al. | 30/43.92 |
| 2003/0106219 | A1 | 6/2003 | Lau | |
| 2004/0128834 | A1 | 7/2004 | Royle | |
| 2006/0085985 | A1 | 4/2006 | Oh | |
| 2006/0283019 | A1 | 12/2006 | Oh | |
| 2007/0124937 | A1 | 6/2007 | Oh | |
| 2008/0209735 | A1 | 9/2008 | Haczek et al. | |
| 2009/0165305 | A1 | 7/2009 | Kraus et al. | |

FOREIGN PATENT DOCUMENTS

| | | |
|---|---|---|
| DE | 198 45 648 | 4/1999 |
| DE | 198 59 017 | 2/2000 |
| DE | 102 42 091 | 4/2004 |
| JP | 47-60341 | 8/2011 |
| WO | WO-2004/033164 | 4/2004 |

* cited by examiner

HAIR REMOVING DEVICE

CROSS REFERENCE TO RELATED APPLICATIONS

This application is a continuation of U.S. patent application Ser. No. 12/066,455, filed May 9, 2008, now U.S. Pat. No. 8,127,453.

TECHNICAL FIELD

This invention relates to a hair removal apparatus.

BACKGROUND

From DE 36 10 736 A1 there is known a hair removal apparatus, in this case an electrically driven shaving apparatus, on which an actuator head, in this case a short-hair cutter, is movably fastened to the housing. The short-hair cutter includes two shaving foils that extend essentially parallel to the axis of rotation of the actuator head and under each of which respectively one oscillating under cutter with individual sheet-metal disks is slidingly arranged. On this electric shaving apparatus, the short-hair cutter forms the only actuator system.

From DE 198 59 017 C1 there is known in addition a hair removal apparatus which is constructed as a hair clipper and on which the actuator head includes two different actuator systems. In this arrangement two cutting blades are assigned to a single clipper comb and can be coupled, respectively according to the pivot position of the actuator head relative to the housing, to a drive element of the drive mechanism. In this way the clipper comb, which has two rows of cutting teeth, can be brought by means of a pivot movement into an optimum cutting position relative to a skin surface.

The construction of two cutting blades on one clipper comb also enables in advantageous manner a different construction of the teeth on the clipper comb and the teeth on the two cutting blades, for example in that the width of one row of cutting teeth is constructed substantially smaller than the width of the other row of cutting teeth. As a result it is possible, for example, to cut long hair with the one row of cutting teeth and short hair with the other row of cutting teeth. To make this possible, the actuator head must be pivoted about a pivot axis that in this case lies outside the clipper comb. According to FIGS. 6 and 7 of DE 198 59 017 C1, the cutting teeth row 41 thus comes to rest on the housing 1 and is inactive in this position while the cutting teeth row 40 according to FIG. 7 now projects freely outward and can make contact with the skin. According to FIG. 6, the cutting teeth row 41 had adopted its active position, meaning its shaving position, and the cutting edge 40 its rest position before the actuator head was pivoted.

With this hair clipper, the apparatus must also be turned in the hand when switching from the one clipper comb to the other clipper comb because the direction of the cutting plane is also shifted from one side of the housing to the other. Consequently, the electric switching device is moved from the outside, where it was easy to actuate with the thumb, to the inside of the hand where it is therefore no longer easy to reach. Because the pivot axis lies outside the clipper comb, the comb is rotatable only to a limited degree in the housing.

SUMMARY

In one aspect, a hair removal apparatus features actuator systems that can be brought into their active operating position through adjustment of the actuator head with easy handling of the apparatus. Because the actuator head forms a rotary body that is freely rotatable about an axis of rotation in the housing of the hair removal apparatus, the entire circumference of the actuator head can be used for providing actuator systems, each of which reaches the required hair treatment plane respectively once during one rotation of the actuator head through 360°. At the same time the apparatus can be held in the same position without any change of position by the hands.

Through the circumferential construction of the individual actuator systems on the actuator head, the actuator head in one embodiment takes on a roller or drum-shaped form, whereby the axis of rotation of the actuator head also extends in the longitudinal direction of the individual actuator systems. If two actuator systems are provided on the actuator head, said systems are advantageously arranged in diametrically opposite positions and the actuator head takes on the form of a right parallelepiped whose circumferential end faces are slightly curved outwards in order to produce better contact with a user's skin.

Actuator heads may include, for example, a short-hair cutter in the form of one or two foils and a cutter engaging the foil(s) from underneath, a center cutter, a long-hair cutter or a plucking device for plucking hairs, which are provided circumferentially on the actuator head and driven by at least one or more drive mechanisms. In addition the actuator head can be equipped with a parking position, i.e., when said head is turned into this plane, all other actuator systems are deactivated and enclosed by the housing to the extent that it is hardly possible for these systems to be damaged, for example during a cleaning operation or accidental bumping of the apparatus.

Hence the actuator systems are not accessible in the rest position. Such a concept enables, for example, a shaving head to be equipped with various shaving systems. Examples of possible variations in the construction of an actuator head include a short-hair cutting system with an opposite, extendible long-hair cutting system and a parking position that is provided between the two shaving systems on the actuator head. In this arrangement the short-hair cutting system rests protected in the housing while the long-hair cutting system projects radially outwards and can make contact with a user's skin in order to cut off the hairs as close as possible to the skin.

Also conceivable however would be a hair removal apparatus with two opposing short-hair cutting systems equipped with different foils such that the one short-hair cutting system could be used for pre-cutting and the other short-hair cutting system for finish-cutting. As another variant it would also be conceivable to make added provision for a long-hair cutting system that is radially extendible from the circumferential side of the actuator head for cutting contours or for forming designer stubble. Instead of constructing different cutting systems on the actuator head it is also possible in addition for an epilator to be integrated in the head.

In some implementations, the plane of rotation of the actuator head extends in the longitudinal direction of the treatment planes of the individual actuator systems, thus resulting in particular ease of handling of the hair removal apparatus. Like a rotating drum, the actuator head can be turned about its axis of rotation until the corresponding actuator system, for example a short-hair cutter, points radially outwards away from the hair removal apparatus, i.e., its treatment plane extends perpendicular or at an angle to the longitudinal axis of the housing, and therefore can be easily moved against the hair surface to be treated without the housing getting in the way.

In some cases, the actuator head has both its ends rotatably mounted on the housing, and a stable mounting of the actuator head on the housing results; in this case, however, the actuator head is accessible only circumferentially from the outside and not from its two ends. With this embodiment, the axis of rotation is supported on the housing at both ends.

In other cases, the actuator head has only its one and narrower end rotatably mounted on the housing, thus enabling better accessibility also from the one side of the actuator head. The overhung mounting of the actuator head simplifies the mounting and enables a simpler housing design to be obtained. However, with the overhung mounting arrangement it is necessary to construct the mounting stable enough for the bending forces acting on the actuator head when placed against a user's hair surface to be absorbed by the mounting without damage. Another advantage is that, because of the freely accessible side of the one actuator surface, the freely accessible side can better reach into individual surface depressions or into other intractable corners of the skin such as certain areas behind the ear or the region underneath the nose.

With the overhung mounting of the actuator head, a bearing journal projects from the end for close-fitting engagement with a bore constructed on the housing where the journal is fixedly located. In this arrangement the journal and the bore combine to form a closely toleranced slide fit in which the actuator head can be turned free of play. It is possible to select, for example, snap rings or other clip fasteners as fixing elements for fixing the actuator head via the journal in the housing.

In some embodiments, the actuator head is turned by hand about its axis of rotation in order to move a desired hair treatment system into the active position of the actuator head. In some cases, provision is made between the actuator head and the housing for detent means which indicate to a user when the desired actuator system has adopted its correct position relative to the housing and a shaving or plucking operation can be started. Thereafter the actuator head can be moved into its rest position, which can also be done automatically by the apparatus itself after the apparatus is switched off. At the same time the actuator head is locked against rotation in order to prevent the actuator head from being turned accidentally during a hair treatment operation.

As another alternative for adjusting the actuator head it is possible to use for the actuator head an electrically driven adjusting unit which with each actuation of the switch for the adjusting unit turns the actuator head until the switch is switched off again. It is also conceivable for the electric adjusting unit to turn, with each actuation of the switch, the actuator head until the next actuator system is moved into its operating position. In this arrangement it is an advantage for the electric adjusting device to include an electrically driven motor which is arranged in addition to the cutting system and turns, via a transmission device, the actuator head into the desired active position.

In some implementations, the transmission device includes a gearwheel arrangement between the drive motor and the actuator head, whereby the bearing journal can then be constructed simultaneously as a gearwheel which is coupled via a gearwheel connected to the drive shaft of the drive motor. However, it is also conceivable to provide a toothed belt that connects the drive shaft of the electric motor to the bearing journal. Also possible are transmission belts or other transmission units for transmitting the torques. It is also conceivable for the drive motor to be coupled directly to the journal of the actuator head in order to dispense entirely with the transmission device.

In some implementations, rotation of the actuator head by the additional electric drive mechanism is variable such that the optimum accessibility of the actuator face to the corresponding skin region can be set for each individual user. For this purpose an electric switch is switched on and off in order to attain in small steps the optimum actuator position for the corresponding skin surface.

In certain embodiments, the actuator head is turned back, by means of the electric adjusting device for the actuator head, into its correct position if during the hair treatment operation it leaves its optimum position due to overloading.

In some embodiments, the actuator system includes a short-hair cutter and a long-hair cutter. Preferably, the short-hair cutter and the long-hair cutter are arranged in diametrically opposite positions on the circumference of the actuator head. In this embodiment there remains sufficient space in the actuator head for accommodating the drive mechanisms of the two cutting systems.

In some implementations, there results between the two systems on the circumferential surface of the actuator head a free space that can serve as a rest for the hair treatment apparatus and thus protects the cutting systems from external impacts or influences. Of course, other combinations of actuator systems on the actuator head are possible such as any combinations of long-hair cutter, medium-hair cutter, short-hair cutter, beard trimmer, epilators, etc. In addition it is possible to construct on the actuator head another guard surface that assumes the rest position of the hair treatment apparatus and protects the cutting systems from external influences when the hair treatment apparatus is not in use. The rest position can also be an advantage in particular when the hair treatment apparatus is inserted in a cleaning center for cleaning the actuator head; by providing one or more slits in the guard surface they could then be used as inlets and outlets for the cleaning fluid.

It is also possible for a hair removal apparatus to have an actuator head on which an epilator in addition to a long-hair cutter and short-hair cutter is provided on the actuator head.

In some cases, a drive mechanism for the actuator head is provided. The drive mechanism can include a linear motor that is accommodated in the interior of the actuator head. Compared to conventional rotary electric motors, linear motors have the advantage of dispensing with transmission devices and of being able to transmit the oscillating movement directly onto the actuator system. Such linear motors can be well integrated in the actuator head because they can be built to particularly small dimensions.

In certain implementations, a water-tight linear motor is disclosed which is particularly easy to manufacture and mounted on both side walls of the actuator head in oscillatory manner. Preferably on a hair cutting system, the linear motor sets the system in oscillation such that the under cutter moves relative to the outer cutter or the blade block moves relative to the shaving foil in order thus to be able to cut off hairs that penetrate between the cutting edges. It will be understood, of course, that the drive mechanism could also be used on epilators.

Two embodiments of the present invention are illustrated in the accompanying drawings and will be described in more detail in the following.

DETAILED DESCRIPTION

Figure 1:
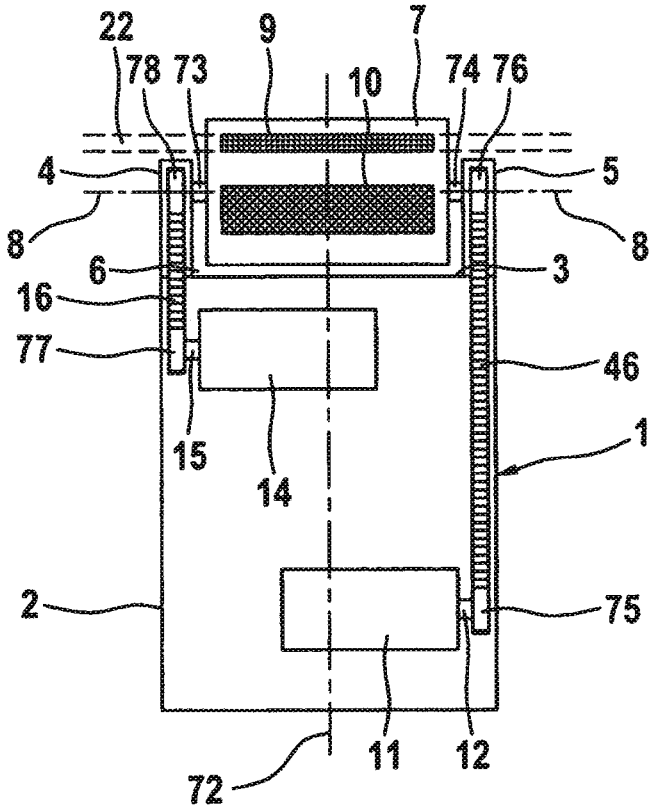
FIG. 1 is a schematic representation of a hair removal apparatus, preferably a shaving apparatus on a reduced scale, on which the actuator head is movably mounted with both its end faces in the housing, the view looking into the interior of the housing.
Figure 2:
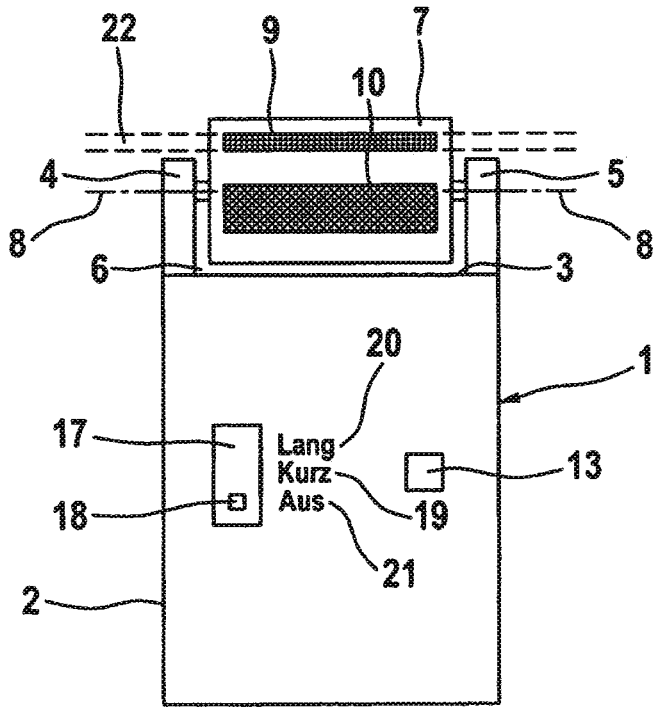
FIG. 2 is a partial plan view of the front side of the hair removal apparatus of FIG. 1.

The hair treatment apparatus 1 schematically presented as a shaving apparatus in FIGS. 1 and 2 includes a housing 2 having on its upper side 3 a respective bearing arm 4, 5 extending upwardly on the edges of the housing 2, thus forming between said arms a receptacle 6 that serves to accommodate an actuator head 7, in this case a shaving head. The actuator head 7 is rotatably mounted via bearing journals 73, 74 on the bearing arms 4, 5. The center line of the bearing journals 73, 74 forms the shared bearing axis 8, which is the axis of rotation of the actuator head 7. The bearing axis 8 extends perpendicular to the longitudinal dimension of the housing 2, i.e., horizontally according to FIGS. 1 and 2. The actuator head 7 is freely rotatable, meaning rotatable through 360°, in the housing 2.

Arranged circumferentially on the actuator head 7 are two actuator systems 9, 10, whereof, for example, the first actuator system 9 can be a long-hair cutter and the second actuator system 10 a short-hair cutter. In FIGS. 1 and 2 the first actuator system 9, namely the long-hair cutter, is in its active plane 22. In this case the long-hair cutter occupies a position in which it can be optimally moved against a user's skin surface. Long hairs can be particularly well cut in this position.

In FIG. 1 the housing 2 is shown partially cut-away to expose the interior of the housing. Evident in schematic form in the housing 2 is a first drive motor 11 that drives, via a drive shaft 12, a gearwheel 75 that is rotationally connected, via a toothed belt 46, to a rotary gearwheel 76 in the right-hand bearing arm 5, which gearwheel drives a shaving system constructed in the shaving head 7 in order to drive both the long-hair cutter 9 and the short-hair cutter 10. The bearing axis of the output-side gearwheel 76 extends concentrically within the bearing journal 74, which is constructed as a hollow shaft. The drive motor 11 can be switched on and off via an On/Off switch (FIG. 2).

In FIG. 1 the housing 2 accommodates above the drive motor 11 another drive motor 14 that drives, via its drive shaft 15, a drive pinion 77 that for its part drives, via a toothed belt 16, a gearwheel 78 arranged centrically to the bearing axis 8 and rotatably mounted in the left-hand bearing arm 4, said gearwheel 78 being non-rotatably connected, via the bearing journal 73, to the actuator head 7 and rotating said actuator head into the corresponding active plane 22 in accordance with the desired cutting position. Provided on the outside of the housing 2 is a switching device 17 (FIG. 2) whose actuating button 18 can be moved either into the short-hair cutting position 19 or into the long-hair cutting position 20. The off position 21 can be used, for example, to turn the actuator head 7 about its axis of rotation 8 until both cutting systems 9, 10 are turned into a protected position in the receptacle 6 and instead a rest region on the actuator head 7 arrives in the active plane 22, said rest region serving to intercept external mechanical influences acting on the actuator head in order thus to protect the cutting systems 9, 10 from damage.

Because the shaving head 7 of FIGS. 1 and 2 has both its ends rotatably mounted on the bearing arms 4, 5 via its axis of rotation 8, it can also transfer the transverse forces, which act on the shaving head 7 during a shaving operation, evenly to the housing 2. Integrated as actuator systems in the actuator head 7 there can also be an epilating arrangement for plucking the hairs as well as a long-hair cutting arrangement or a short-hair cutting arrangement, all of which are driven by one and the same drive motor 11.

According to FIGS. 3 to 7, the actuator head 7 shown here as a shaving head has only one of its ends mounted on a left-hand bearing arm 4 and is likewise freely rotatable, meaning rotatable through an angle of 360°. By virtue of the overhung mounting of the actuator head 7 of FIGS. 3 to 7, said head can be used in particular on hard-to-reach areas of skin in that the region of the actuator system 10 in the vicinity of the free end of the actuator head 7 is guided into the skin depressions.

To avoid repetitions, like reference numerals are selected as a rule in FIGS. 3 to 8 for correspondingly like elements of FIGS. 1 and 2.

In FIGS. 3 to 8 the actuator head 7 includes a shaving head, which could be replaced however by an epilator head with an integrated shaving part.

Figure 3:
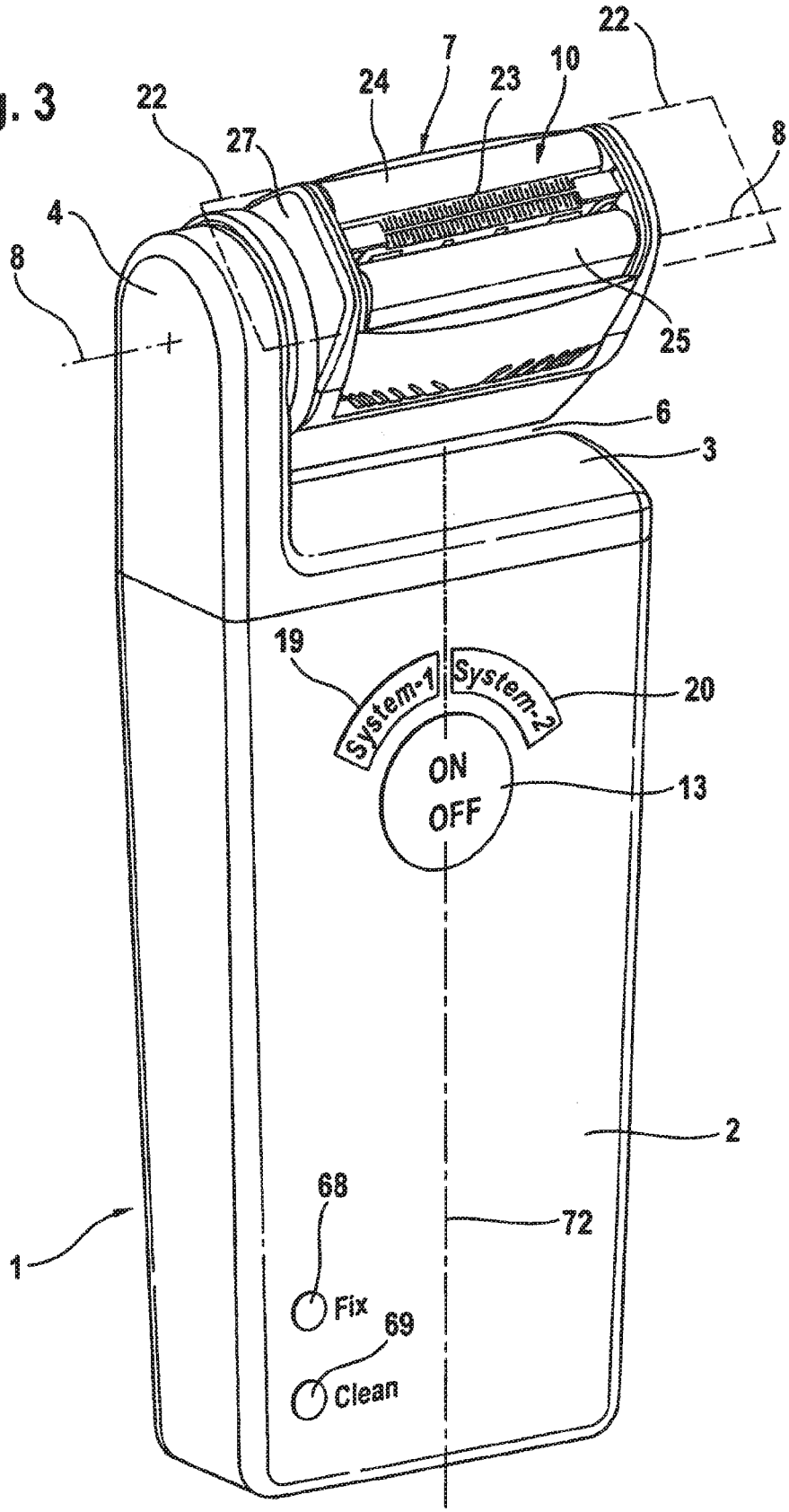
FIG. 3 is a perspective front view of a second embodiment of a hair removal apparatus, here preferably a shaving apparatus, showing the apparatus on an enlarged scale and, unlike in FIGS. 1 and 2, the actuator head movably mounted on the housing with only one end.

In FIG. 3 the shaving head 7 has adopted the position which corresponds to the active plane 22 of the short-hair cutter 10 and of an integrated center cutter 23. The short-hair cutter 10 includes two outwardly curved shaving foils 24, 25 which extend in longitudinal direction parallel to the axis of rotation 8, underneath each of which an associated under cutter is reciprocated in oscillating fashion. The same applies analogously also for the center cutter 23. The active position of the short-hair cutter 10 and the center cutter 23 is selected such that when the active plane 22 touches a user's skin surface, the housing 2 stands off obliquely or perpendicularly outwards from the skin surface and therefore is no hindrance during the shaving operation.

Figure 4:
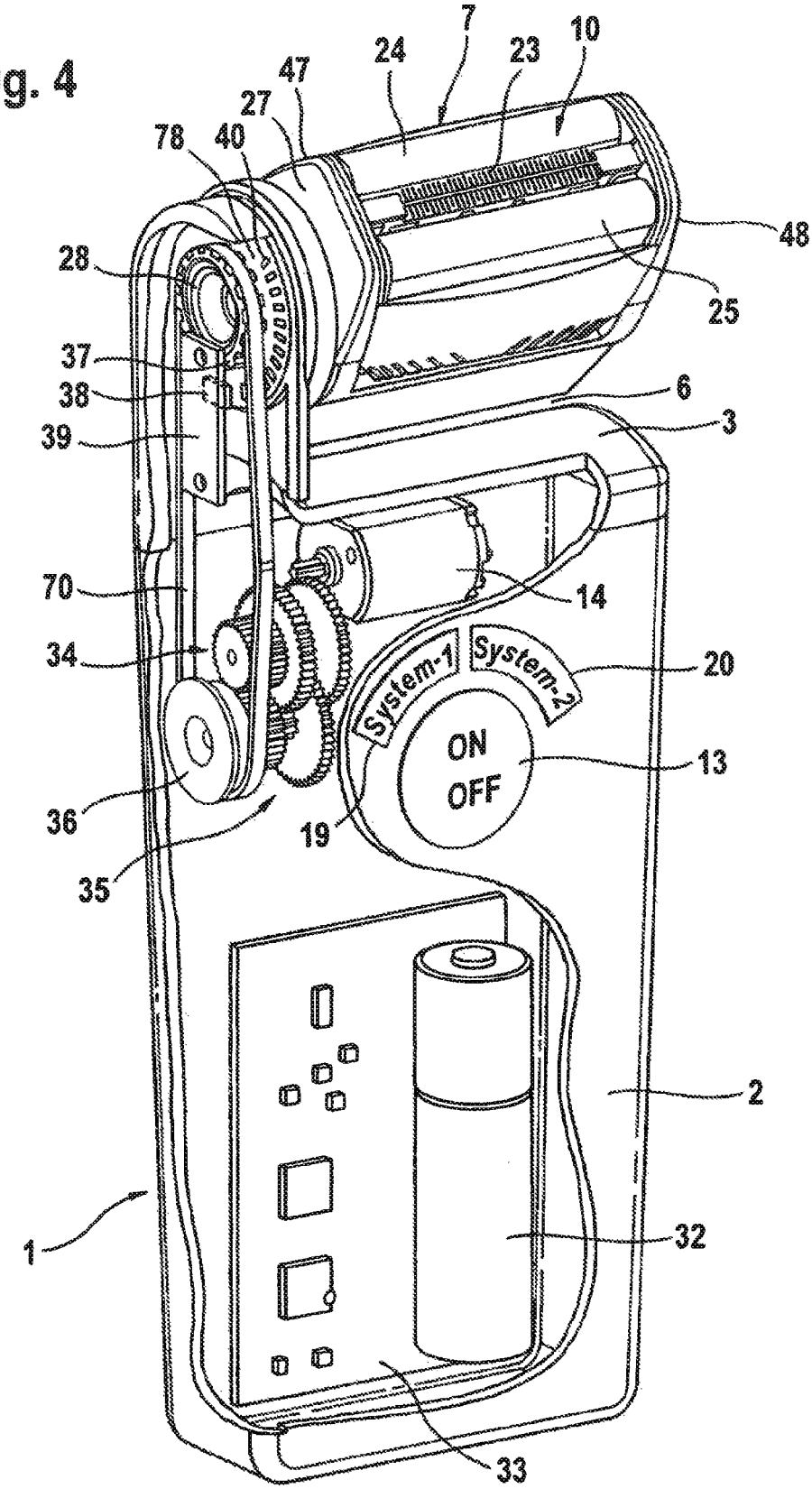
FIG. 4 is a view of the hair removal apparatus of FIG. 3, showing the housing partially cut-away and components of the actuator head drive mechanism in a schematic representation.

The shaving head 7 can be moved about its axis of rotation or bearing axis 8 either by hand or electrically, as becomes apparent from FIG. 4. If the shaving head 7 is turned about its axis of rotation 8 by hand, then it is advantageous for detent means provided between the shaving head 7 and the bearing arm 4 to lock the shaving head 7 in place as soon as the short-hair cutter 10 or the long-hair cutter 26 (FIG. 5) has reached the active plane 22. The detent means can be, for example, a spring-loaded ball that lockingly engages into a depression provided on the end face 27. Hence two depressions would be needed on the shaving head 7 for two actuator systems.

Figure 6:
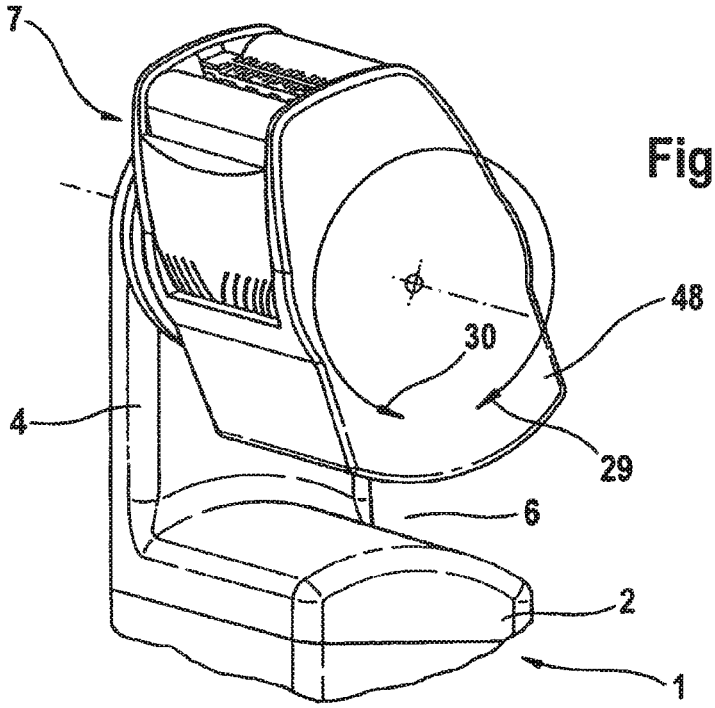
FIG. 6 is a perspective view, in the direction X of FIG. 5, of the upper part of the hair treatment apparatus in the region of the actuator head, the side view in the direction X being of that side of the actuator head that is not movably mounted on the housing.
Figure 8:
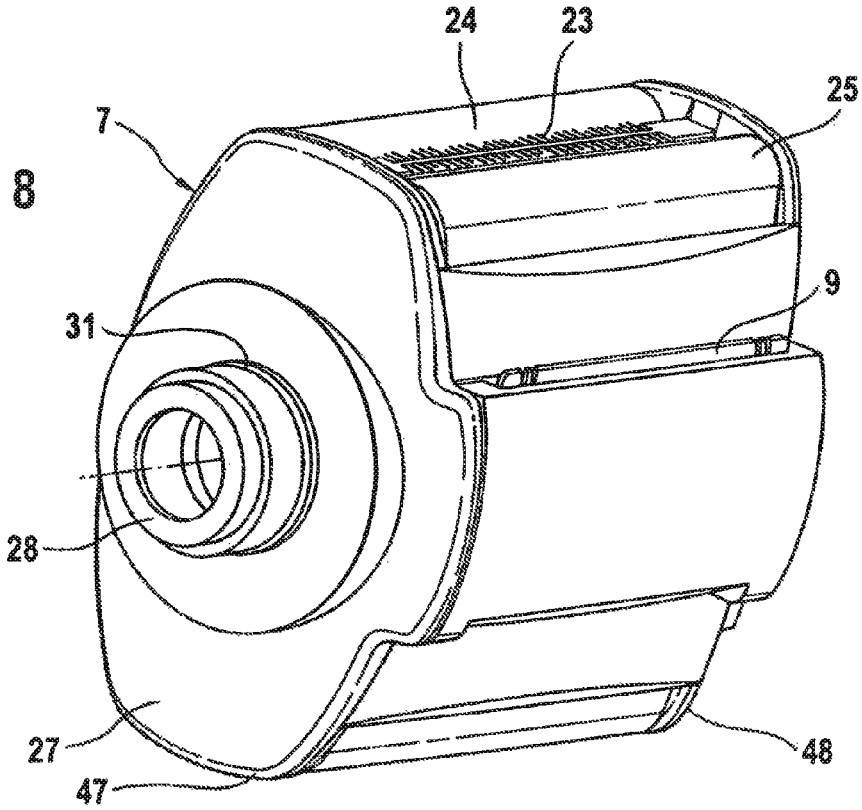
FIG. 8 is a perspective view of the actuator head itself, according to FIGS. 3 to 7, but in the demounted state and on an enlarged scale.

According to FIG. 8 the shaving head 7 is rotatably mounted, via a centrally projecting bearing journal 28 on the left-hand end face 27, in a mating bore formed in the bearing arm 4, whereby the actuator head 7, in this case a shaving head, can be turned according to FIG. 6 in both directions of rotation 29, 30. Constructed circumferentially on the bearing journal 28 is a groove 31 that serves to fixedly locate the journal in its mating bore on the bearing arm 4. For this purpose it is possible preferably for a spring-loaded lock ring to be fastened in an annular groove in the mating bore so that when the bearing journal is inserted into the mating bore, said lock ring engages in the groove 31, thereby supporting the shaving head 7 such that it is fixedly located on the bearing arm 4 but is free to rotate about the axis of rotation 8.

As the shaving apparatus 1 of FIG. 4 shows, the interior of the housing 2 accommodates an electrically driven drive motor 14 that is connected via electric leads to the switch for turning the actuator head 7 into the active position of the short-hair or long-hair cutting system 19, 20 and is adapted to be coupled via further electric connections to a storage battery 32 provided in the housing 2. The storage battery 32 is electrically controlled by a printed circuit board 33.

According to FIG. 4 the drive motor 14 is rotationally connected via a transmission device 34 to the bearing journal 28 of the actuator head 7. In this arrangement the transmission device 34 includes several meshing gearwheels 35, whereby the output-side wheel 36 serves as a belt drive and thus drives a belt 70. The belt 70 is connected to a gearwheel 37 formed on the bearing journal 28. At this point it should be noted that the teeth formed on the belt 37 on the inside and the teeth formed on the circumference of the wheel 36 are not shown in the drawing for the sake of simplicity. However, in FIG. 4 the gearwheel formed on the bearing journal 28 is shown in the drawing whereas in FIG. 8 it is shown for the sake of simplicity simply as a groove but of course it also has teeth the same as in FIG. 4.

In FIG. 4 there is also fastened to a mounting plate 39 in the bearing arm 4 an electrically driven position detector 38 that registers with windows 40 provided in the end face 78 and evenly distributed over the circumference in order to stop the electrically driven drive motor 14 via electric leads when the desired actuator system 9, 10 is in the correct actuator or active plane 22.

Figure 7:
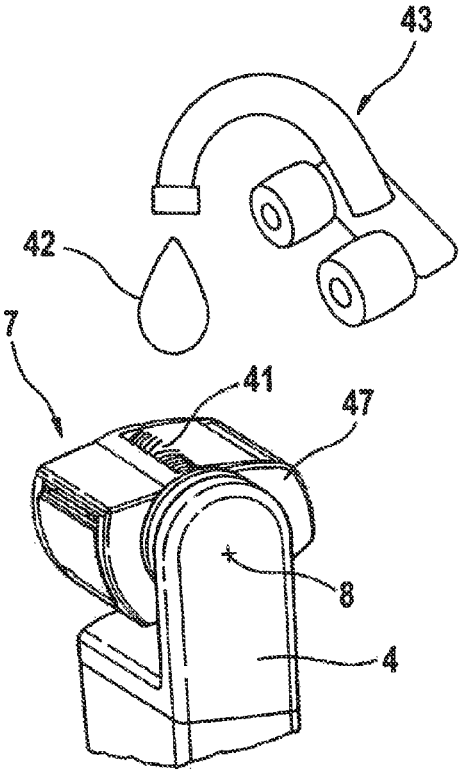
FIG. 7 is a plan view on a reduced scale from obliquely above the actuator head as seen looking from the mounting end of FIG. 5, with the actuator head having been turned into its cleaning position where it can be held under a water faucet (schematically shown above) for cleaning purposes.

In FIG. 7 the actuator head 7 is shown turned to the point where a cleaning opening 41 is accessible from above so that water (represented by a droplet 42) can be filled into the actuator head 7. A water faucet 43 symbolizes the source of cleaning fluid.

Figure 9:
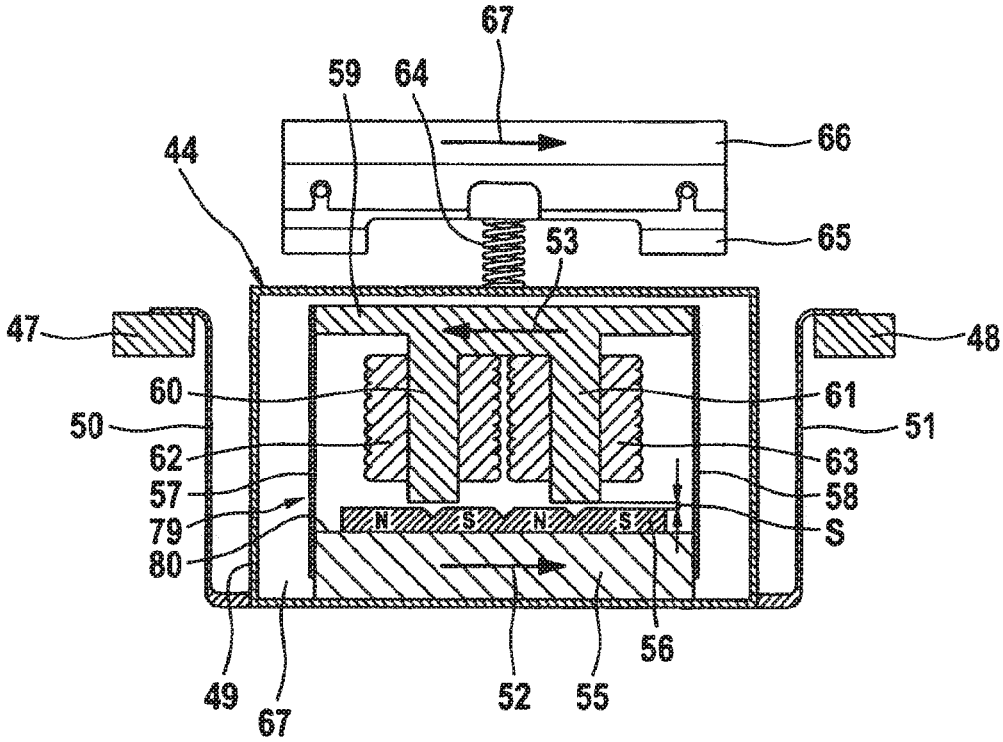
FIG. 9 is a schematic sectional representation of a linear motor that can be integrated, for example, in the interior of the actuator head shown in FIGS. 3 to 8.

Illustrated in FIG. 9 is finally another electric drive mechanism 79 that includes a linear drive motor 44. This linear drive motor 44 is also suitable, for example, for installing in the actuator head 7 of the shaving apparatus of FIGS. 3 to 8, whereby the shaded rectangles to the right and left of the linear drive motor 44 of FIG. 9 represent parts of the two side walls 47, 48 of the actuator head 7 that carry the linear drive motor 44, hereinafter referred to only as linear motor.

According to FIG. 9 the linear motor 44 is comprised essentially of a stator frame 49, which is constructed in the shape of a box and closed to be watertight, with external spring elements 50, 51 similar to leaf springs being fastened to both sides of the frame to serve as oscillating bridges. The spring elements 50, 51 have their other ends securely connected to the side walls 47, 48 of the actuator head 7. In this way the stator frame 49 can oscillate to and fro in the horizontal direction according to the arrows 52, 53. The external spring elements 50, 51 can be manufactured preferably from metal and can simultaneously provide the power supply for the linear motor 44. Fastened to the bottom of the stator frame 49 is a stator 55 with magnets 56 mounted on the upper side.

Extending upwards on the side walls of the stator 55 are respectively one oscillating spring 57, 58, said springs being connected with each other via a coil core 59. Extending downwards from the coil core 59 are two adjacent cylindrical core sections 60, 61, which are encompassed by respectively one annular coil 62, 63. The free ends of the core sections 60, 61 end a short distance from the magnets 56 on the stator 55, thus defining a predetermined gap S. The core sections 60, 61 are arranged such that each is arranged between a north pole and a south pole of the magnet 56. The north pole is indicated with N and the south pole with S in FIG. 9.

On the one hand the leaf springs 57, 58 of FIG. 9 establish the predetermined gap S and on the other hand they form the oscillating springs that are necessary for the resonance operating mode. However, the leaf springs 57, 58 could also be separate elements, such as for example compression springs, which can be inserted between the stator 55 and the core sections 60, 61.

The mode of operation of the shaving apparatus 1 of FIGS. 1 and 2 is as follows:

First a user must decide whether he wants to use the short-hair cutting system 10 or the long-hair cutting system 9. If he wants to use the short-hair cutting system 10, then he sets the actuating button 18 to the position "Kurz" (short) 19. The drive motor 14 now switches on and rotates the drive belt 16 and hence the actuator head, in this case opposite to the direction of rotation, about the axis of rotation 8 until the short-hair cutting system 10 has reached the active plane 22. To reach this position the drive motor 14 could be a stepper motor that is turned by an electronic control device.

It is also conceivable, however, for a sensor device to be provided between the bearing arm 4 and the actuator head 7, such as becomes apparent from FIG. 4. On a standard shaving head 7 it is possible as a rule to select among only three positions, namely the fine shave position, the long shave position and the rest position, hence three markings corresponding to these positions can be provided on the actuator head 7 such that the sensor detects and selects them according to the desired actuator system and stops upon reaching the optimum shaving position. The active plane 22 is the plane which with regard to the housing 2 represents the optimum shaving plane of the actuator head 7 relative to the housing 2. In this position a user's hand also adopts an optimum position relative to the housing 2 and a user's skin surface. The switch 13 can now be switched on and the short-hair cutting system 10 will be driven.

If, after the short-hair shave, a user would now like to cut for example his sideburns, then he must first push the actuating button 18 into the long-hair cutting position 20. For this purpose the switch 18 is moved into the "Lang" (long) position 20. The drive motor 14 now turns, via the transmission device 16, the actuator head 7 until the long-hair cutter 9 has reached the active plane 22. The sideburns can now be cut by moving the switch 13 into the On-position. The drive motor 11 now turns, via the transmission device 15, 77, 16, 78, 73, the shaving system provided in the actuator head 7. This applies similarly for switching on the short-hair cutting system, as was previously mentioned.

If the user now wants to put down the shaving apparatus 1, the actuating button 18 is switched to the Off-position 21 and the drive motor 14 turns, via the transmission device 16, the actuator head 7 about the longitudinal axis 8 until both shaving systems 9, 10 are concealed in the receptacle 6 and therefore cannot be damaged. This is possible, when both shaving systems lie close together in order to be protected in the receptacle 6.

The mode of operation of the shaving apparatus of FIGS. 3 to 9 is as follows:

Here too the user first decides which cutting system 19, 20 he wants to use. If the short-hair cutting system 10 (System 1) is to be used first, then there is no need to actuate the short-hair cutter button 19 because the shaving apparatus 1 of FIGS. 3 and 4 has already adopted this position, i.e., the two short-hair cutters 10, which extend side by side and parallel with each other, and the center cutter 23 arranged in between are already in the active plane 22. The apparatus can now be switched on via the On/Off switch 13, and the electronic controller on the printed circuit board 33 controls via power connections, not shown in the drawing, the linear motor 44 provided in the actuator head 7. Through the magnetic excitation of the coil core 59 and the core sections 60, 61 integrally formed therewith, by the coil 62, 63, there develops on the core sections 60, 61 an alternating magnetic field that causes said sections to oscillate relative to the stator 55.

As the arrows 52 and 53 in FIG. 9 show, the core sections 60, 61 oscillate in opposite direction of the stator 55, whereby the stator frame 49 is set in oscillation by the acceleration forces, said motion being promoted by the spring elements 50, 51. The oscillating motion of the stator frame 49 is transmitted via the spring 64 onto the moving part 65 (blade block), which thus produces the shaving motion relative to the stationary part (shaving foil). A user can now slide the short-hair cutter 10 across the skin surface and cut off very fine hairs in the process.

The drive of the linear motor 44 operates in oscillating fashion at very high short-stroke frequencies, with the entire linear motor 44 being embedded completely watertight in the stator frame 49. The actual oscillating shaving parts are arranged outside the stator frame 49 and as such can easily be cleaned with water without water being able to penetrate into the internal space 67 of the linear motor 44. It will be understood, of course, that it is possible, instead of coupling the shaving parts 65, 66 to the stator frame 49, to couple different types of drive elements directly and without sealing to various locations. Such drive elements can be, for example, long-hair cutters, short-hair cutters, center cutters and other actuator systems that can be driven via oscillating movements.

Figure 5:
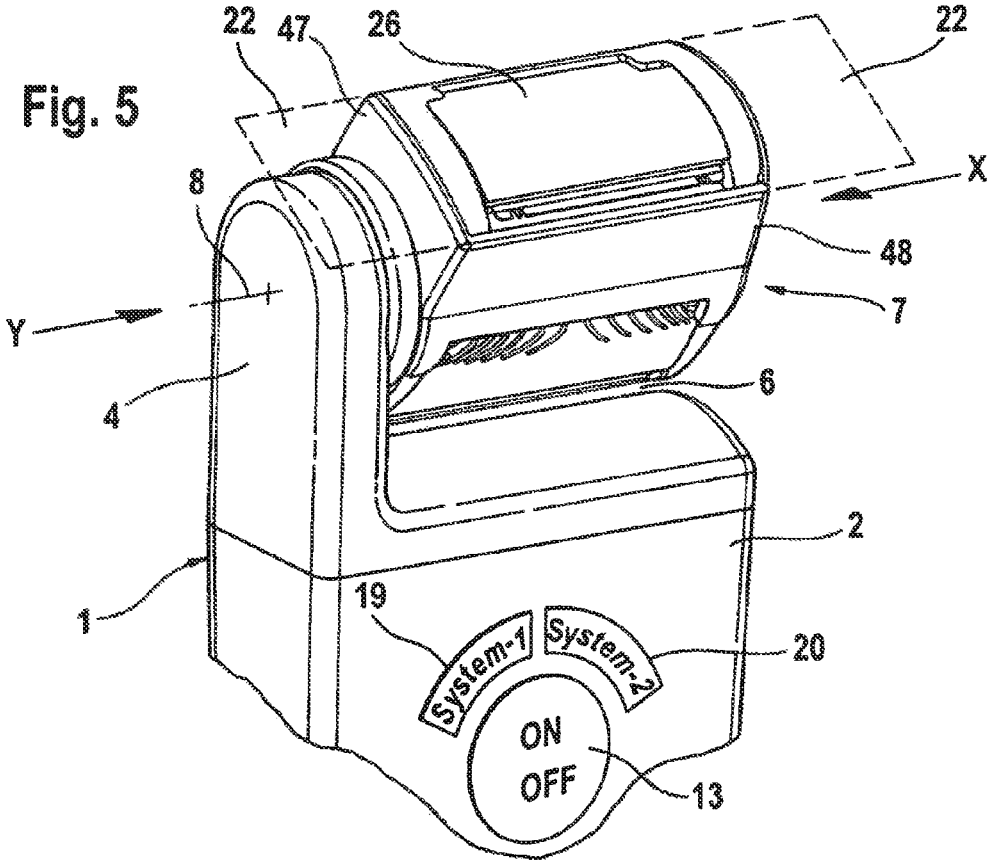
FIG. 5 is a perspective partial view of part of the housing and the entire actuator head of FIGS. 3 and 4, with the actuator head having been turned about its axis of rotation such that a second cutting system, namely a long-hair cutter, has been moved into the active position in lieu of the cutting system occupying the active position in FIGS. 3 and 4.

If the user now wants to cut sideburns or head hair profiles, then according to FIG. 5 he must move the long-hair cutting system 26 into the active plane 22. This is done by actuating the actuating button 20 for the long-hair cutting system (System 2). Using electric control means, the drive motor 14 is now set in rotation and for its part turns, via gearwheels 35, 36, 37 and the toothed belt 70, the actuator head 7 about its axis of rotation 8 until the long-hair cutter 26 has reached the active plane 22 (FIG. 5). In this position, a position detector 38 sends an electric signal to the electronic components on the printed circuit board 33 so that the drive motor 14 switches off. To determine the correct position of the actuator head 7, windows 40 are evenly distributed over the circumference on the side wall 47 through which the position detector 38 detects the desired position of the actuator head 7 and then switches off the electric motor 14. The switch 13 can now be switched on again and the long-hair cutting system 26 is driven and profiles can be cut.

What is claimed is:

1. A hair removal apparatus, comprising;

(i) a housing;

(ii) an electric drive; and (iii) a hair removing head comprising a hair removal region, said hair removal region being driven by the electric drive to engage and remove hairs, wherein the head is rotatable 360° about an axis extending through the head, from a positioning which the hair removal region is directed away from the housing for removing hair, to a position in which the hair removal region is directed toward the housing, and wherein the head is configured to lock in the position in which the hair removal region is directed away from the housing; and wherein the housing further comprises arms between which the head is rotatably mounted; and wherein the head is rotatable by hand about the axis of rotation; and further comprising an electically drive adjusting unit, wherein the head is rotatable about the axis of rotation by the adjusting unit, said electrically driven adjusting unit comprising an electric motor and a transmission arranged to turn the head to the position in which the hair removal region is directed away from the housing, said transmission comprising a cooperating gearwheel unit; and wherein the position in which the hair removal region is directed away from the housing is adjustable by a user within predefined limits; said apparatus further comprising an electric control configured to automatically adjust the head such that the hair removal region is returned to the position in which the hair removal region is directed away from the housing following rotation about the axis of rotation of the head by external forces.

2. A hair removal apparatus, comprising;

(i) a housing;

(ii) an electric drive; and (iii) a hair removing head comprising a hair removal region driven by the electric drive, to engage and remove hairs, wherein the head is rotatable about an axis extending through the head from a position in which the hair removal region is directed away from the housing for removing hair, to a position in which the hair removal region is directed toward the housing; wherein the housing further comprises arms between which the head is rotatably mounted;

wherein the apparatus further comprises an electrically driven adjusting unit comprising a second electric drive and a transmission comprising a cooperating gearwheel unit, arranged to turn the head to the position in which the hair removal region is directed away from the housing, and wherein the head is rotatable about the axis of rotation by the adjusting unit and wherein:

the hair removal apparatus further comprises an electric control configured to automatically adjust the hair removing head such that the hair removal region is returned to the position in which the hair removal region is directed away from the housing following rotation about the axis of rotation of the head by external forces;

wherein the head is configured to lock in the position in which the hair removal region is directed away from the housing.

* * * * *